US009574464B2

(12) United States Patent
Flender et al.

(10) Patent No.: US 9,574,464 B2
(45) Date of Patent: Feb. 21, 2017

(54) CAMSHAFT FOR AN INTERNAL COMBUSTION ENGINE

(71) Applicant: Mahle International GmbH, Stuttgart (DE)

(72) Inventors: Thomas Flender, Eberdingen (DE); Michael Kreisig, Stuttgart (DE); Falk Schneider, Korntal-Muenchingen (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 14/037,994

(22) Filed: Sep. 26, 2013

(65) Prior Publication Data

US 2014/0083382 A1 Mar. 27, 2014

(30) Foreign Application Priority Data

Sep. 26, 2012 (DE) ..... 10 2012 217 456

(51) Int. Cl.
*F01L 1/14* (2006.01)
*F01L 1/34* (2006.01)
*F01L 1/047* (2006.01)

(52) U.S. Cl.
CPC ..... *F01L 1/34* (2013.01); *F01L 1/047* (2013.01); *F01L 2001/0471* (2013.01); *F01L 2001/0476* (2013.01)

(58) Field of Classification Search
CPC ..... F01L 2001/0476; F01L 1/34; F01L 1/047; F01L 2001/0471
USPC ..... 123/90.27, 90.31, 90.6, 90.16
See application file for complete search history.

(56) References Cited

U.S. PATENT DOCUMENTS 2,008 A 3/1841 Cornelius
2,010 A 3/1841 King
5,985,708 A 11/1999 Nakagawa et al.
(Continued)

FOREIGN PATENT DOCUMENTS

DE 19710487 A1 9/1997
DE 102006036851 A1 6/2007
(Continued)

OTHER PUBLICATIONS

English Abstract for JP2010059821A.
(Continued)

*Primary Examiner* — Ching Chang
(74) *Attorney, Agent, or Firm* — Fishman Stewart PLLC

(57) ABSTRACT

The present invention relates to a camshaft (1) for an internal combustion engine with a drive wheel (4) arranged on a longitudinal end side, in particular with a chain wheel or belt pulley, and with at least one first bearing (2) arranged in the region of the drive wheel (4) and a second bearing (3) arranged in the further course of the camshaft (1). Here it is substantial to the invention that at least the first bearing (2) is designed as a rolling bearing and has an inner diameter of 24 mm<$d_i$<30 mm, wherein the inner diameter $d_i$ is larger than the outer diameter $d_a$ of the camshaft (1) on the second bearing (3).

Because of this, the camshaft (1) can be configured more compact and lighter.

20 Claims, 3 Drawing Sheets

(56) References Cited

U.S. PATENT DOCUMENTS

| | | | | |
|---|---|---|---|---|
| 7,055,480 | B2 * | 6/2006 | Kusaka | F01L 1/08 123/90.11 |
| 8,051,821 | B2 * | 11/2011 | Kuromatsu et al. | 123/90.6 |
| 2011/0315100 | A1 * | 12/2011 | Schneider et al. | 123/90.1 |
| 2012/0012075 | A1 * | 1/2012 | Schneider et al. | 123/90.1 |

FOREIGN PATENT DOCUMENTS

| | | | | | |
|---|---|---|---|---|---|
| DE | 102010005874 | A1 | | 7/2011 | |
| EP | 1956222 | A1 | | 8/2008 | |
| JP | 2010025013 | A | * | 2/2010 | |
| JP | 2010059821 | A | | 3/2010 | |
| JP | 2011117318 | A | * | 6/2011 | |
| JP | 2011122500 | A | * | 6/2011 | |
| JP | 2011127506 | A | * | 6/2011 | |
| JP | 2011133081 | A | * | 7/2011 | |
| JP | 2011133081 | A1 | * | 7/2011 | F16C 33/60 |
| WO | WO-2012/001517 | A1 | | 1/2012 | |

OTHER PUBLICATIONS

EP Search Report for EP13182637 dated Jan. 21, 2014.
English abstract for DE-102006036851.
English abstract for DE-102010005874.

* cited by examiner

CAMSHAFT FOR AN INTERNAL COMBUSTION ENGINE

CROSS-REFERENCE TO RELATED APPLICATIONS

This application claims priority to German Patent Application 10 2012 217 456.7 filed Sep. 26, 2012, which is hereby incorporated by reference in its entirety.

TECHNICAL FIELD

The present invention relates to a camshaft for an internal combustion engine with a drive wheel arranged on a longitudinal end side, in particular with a chain wheel or pulley, and with at least one first and one second bearing, according to the preamble of Claim 1.

BACKGROUND

Generic camshafts are thoroughly known and employed in a wide range of embodiments in modern internal combustion engines. In order to be able to achieve as smooth a mounting of such a camshaft as possible, these are usually mounted via so-called rolling bearings, i.e. for example in needle or ball bearings. In particular on the longitudinal end, on which the drive wheel is arranged, the bearing should not undershoot a certain bearing diameter in order to be able to securely absorb the comparatively high bearing forces that occur there. A diameter of 24 mm has been considered as minimal diameter for the camshaft.

SUMMARY

The present invention deals with the problem of stating an improved embodiment for a camshaft of the generic type, which in particular allows using smaller camshaft diameters and thus lighter camshafts.

According to the invention, this problem is solved through the subject of the independent Claim 1. Advantageous embodiments are subject of the dependent claims.

The invention is based on the general idea of improving a mounting of a camshaft, in particular in the region of a drive wheel, i.e. for example in the region of a chain wheel or a belt pulley in that at least the first bearing employed there is designed as a rolling bearing and has an inner diameter between 24 and 30 mm, which is larger than the outer diameter of the camshaft on a second bearing arranged in the further course of the camshaft. Because of this it is possible on the one hand to reliably mount the camshaft and on the other hand design it adjacent to the first bearing with a comparatively small diameter, and because of this construct it compact and also light. Through the larger inner diameter of at least the first bearing, the forces that occur there can be absorbed by the bearing without problems and it is additionally possible to design the remaining bearings for mounting the camshaft smaller. In order to create a reliable connection at least between the first bearing and the camshaft which with respect to this is smaller in diameter, it can be provided that the camshaft is expanded on the longitudinal end side, in particular in the region of the drive wheel and the first bearing is arranged on this expanded region. As a whole, a diameter for the camshaft can thus be realised which away from the first bearing is significantly smaller than with previous camshafts, since only the region carrying the first bearing is now exclusively enlarged. Through the camshaft which is smaller in the remaining regions, it can be configured lighter and less material for producing such a camshaft is required at the same time.

Practically, the expanded region is produced through internal high-pressure forming or through upsetting. Both the internal high-pressure forming as well as the upsetting constitute process-secure and simultaneously cost-effective methods for producing the regions expanded according to the invention and can be individually applied.

Alternatively to the expanding of the camshaft it can also be provided that a sleeve is arranged on the camshaft in the region of the first bearing, onto which the first bearing is mounted. Such a sleeve likewise forms an enlargement of the diameter, wherein such a sleeve can for example be also formed in the manner of a ring in the simplest case. Connecting the sleeve or the ring to the camshaft can be effected for example through a press fit or a thermal joining fit. Obviously, gluing or soldering of the sleeve to the camshaft is also conceivable.

Again alternatively to the previously described camshafts, the first bearing can also be arranged directly on the drive wheel, wherein the drive wheel is connected to the camshaft in a fixed manner, for example pressed into said camshaft for example in the manner of a plug. Here, the drive wheel in addition to the actual drive disc comprises for example a gear wheel, a bearing shoulder which compared with the camshaft is radially enlarged, on which the first bearing is arranged. In this case, working the camshaft, for example through a suitable expanding, is not necessary at all. In addition, the camshaft in the present case can be produced continuously with the same small diameter, i.e. with a diameter that is smaller than 25 mm, for example as a drawn tube.

Practically, at least one of the bearings is designed as a ball bearing or as a needle bearing, as a result of which on the one hand a smooth-running mounting can be achieved and on the other hand in the case of a needle bearing a comparatively compact design can be achieved. In the most favourable case it is even provided that rolling bodies of the needle bearing run directly on an outer surface of the camshaft.

With the camshaft according to the invention, a diameter of $24<d<18$ mm, preferentially a diameter of $d=22$ mm can be realised, which compared with previous camshafts, whose diameter was between 23 and 30 mm, constitutes a clear reduction.

Further important features and advantages of the invention are obtained from the subclaims, from the drawings and from the associated Figure description by means of the drawings.

It is to be understood that the features mentioned above and still to be explained in the following cannot only be used in the respective combination stated but also in other combinations or by themselves, without leaving the scope of the present invention.

Preferred exemplary embodiments of the invention are shown in the drawings and are explained in more detail in the following description, wherein same reference characters relate to same or similar or functionally same components.

BRIEF DESCRIPTION OF THE DRAWINGS

Here it shows, in each case schematically.

DETAILED DESCRIPTION

According to the FIGS. 1 to 6, a camshaft 1 according to the invention comprises a first bearing 2 and a second bearing 3. According to the invention, at least the first bearing 2 is designed as a rolling bearing and has an inner diameter $d_i$ between 24 and 30 mm, which is larger than the outer diameter $d_a$ of the camshaft 1 on the second bearing 3.

Figure 1:
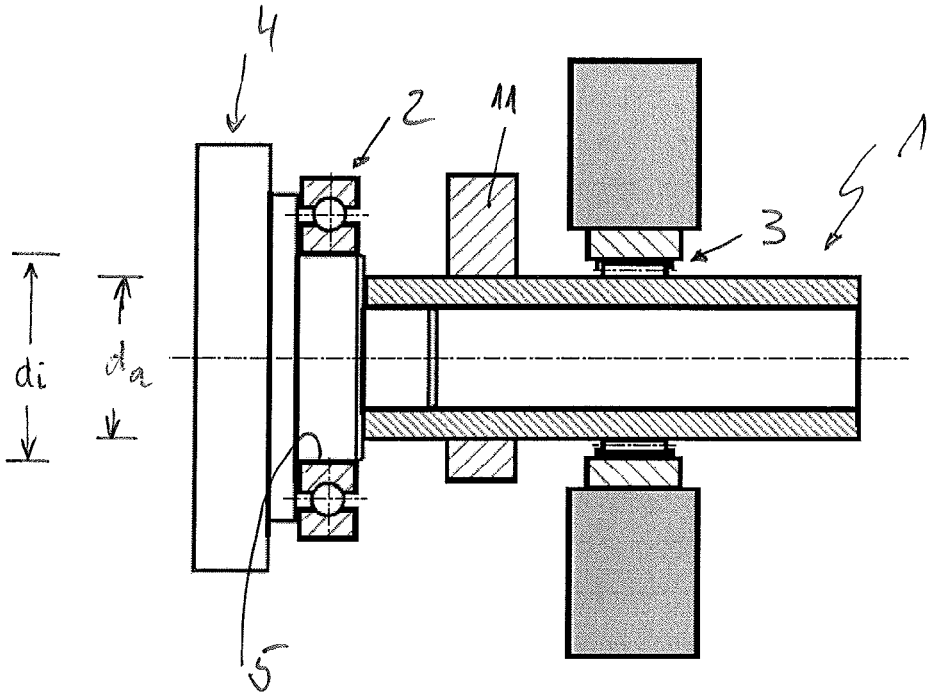
FIG. 1 a sectional representation through a first embodiment of a camshaft according to the invention with a first bearing arranged on a drive wheel, FIG. 2 a first bearing enlarged with the help of a sleeve for mounting the camshaft in the region of a drive wheel which is not shown, FIG. 3, 4 a camshaft according to the invention each with expanded region in the region of the first bearing, FIG. 5 a representation as in FIG. 4, however additionally with a third bearing on a longitudinal end of the camshaft facing away from the drive wheel, likewise on an expanded region, FIG. 6 a representation as in FIG. 4, however with two second bearings of different embodiments.

Looking at the FIG. 1, it is evident that on the camshaft 1 a drive wheel 4 is arranged, for example in the manner of a chain wheel or belt pulley, wherein this drive wheel 4 is pressed together with the camshaft 1 for example in the manner of a plug. In this case, the first bearing 2 is arranged on the drive wheel 4, namely on a bearing shoulder 5, whose outer diameter substantially corresponds to the inner diameter $d_i$ of the first bearing 2 and is likewise larger than the outer diameter $d_a$ of the camshaft 1.

Figure 2:
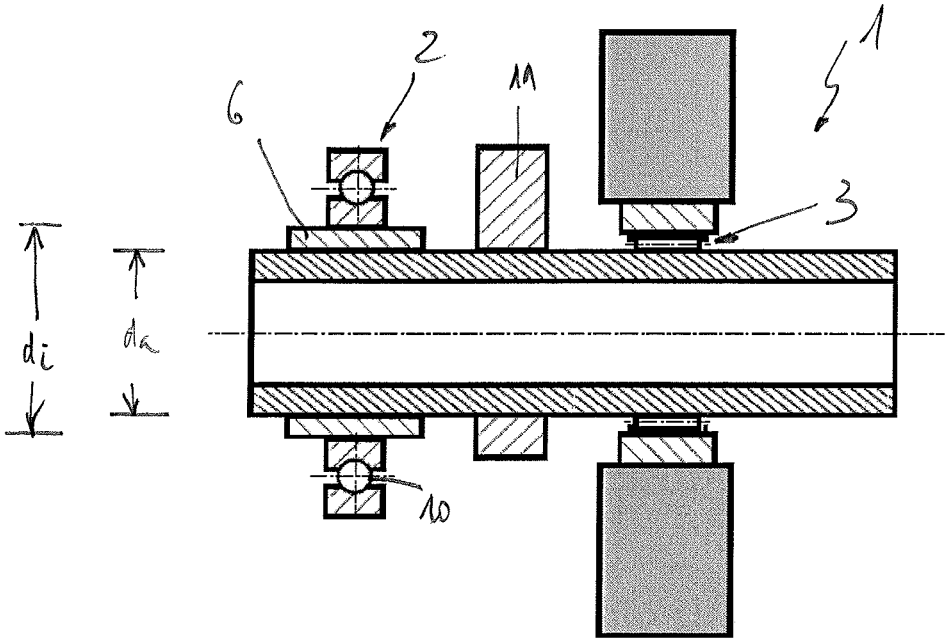

In the case of the camshaft 1 according to FIG. 2, a sleeve 6 or a ring on which the first bearing 2 is arranged, is arranged in the region of the first bearing 2. In this case, too, the inner diameter $d_i$ of the first bearing 2 is thus larger than the outer diameter $d_a$ of the camshaft 1, namely exactly by the thickness of the sleeve 6. The first bearing 2 as well as the sleeve 6 in this case are again arranged in the region of a drive wheel which is not shown this time, or adjacent to this.

The enlarged inner diameter $d_i$ of the first bearing 2 can thus be achieved through the radially larger bearing shoulder 5 on the drive wheel 4 or through a corresponding sleeve 6, wherein the sleeve 6 is pressed onto the camshaft 1 or thermally joined to the latter. Obviously, gluing or soldering or welding the sleeve 6 to the camshaft 1 is also conceivable.

Figure 3:
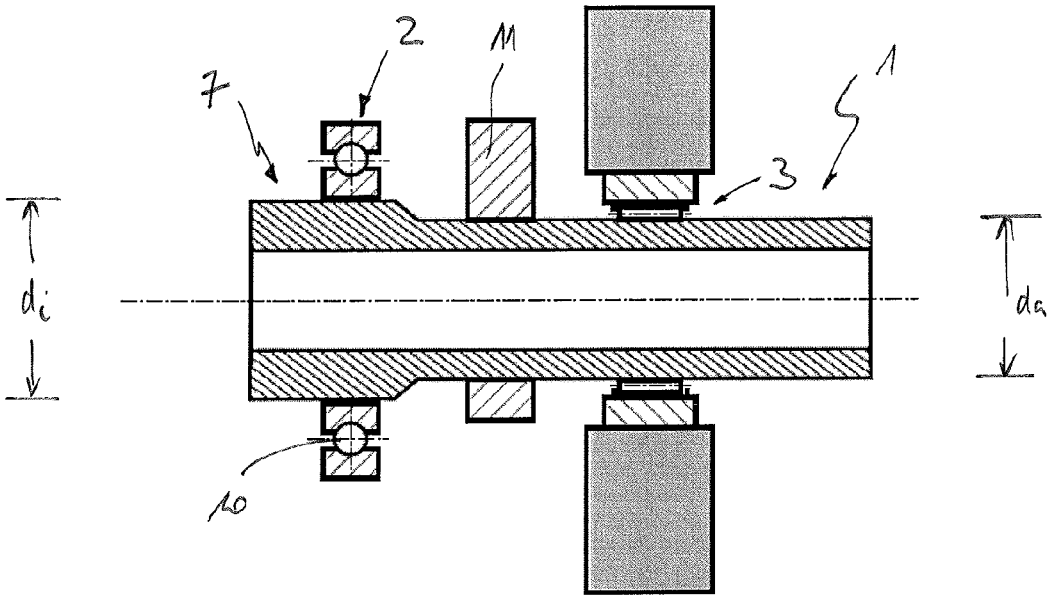
Figure 4:
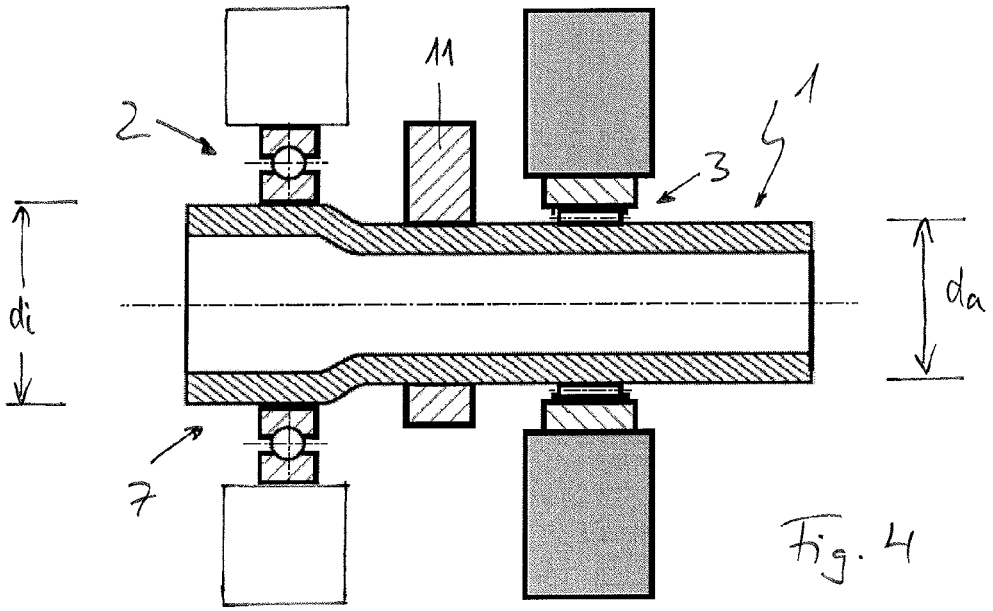

The FIGS. 3 and 4 show a camshaft 1, in the case of which said camshaft 1 is expanded on the longitudinal end side, in particular in the region of the drive wheel 4 which this time is likewise not shown, so that the first bearing 2 is arranged on the expanded region 7 of the camshaft 1. The expanded region 7 in this case can for example be produced through internal high-pressure forming or through upsetting. According to FIG. 3, the expanded region 7 in this case is obtained through material compaction on the camshaft 1, whereas the expanded region 7 according to FIG. 4 can be produced through a forming or internal high-pressure forming or upsetting.

Figure 5:
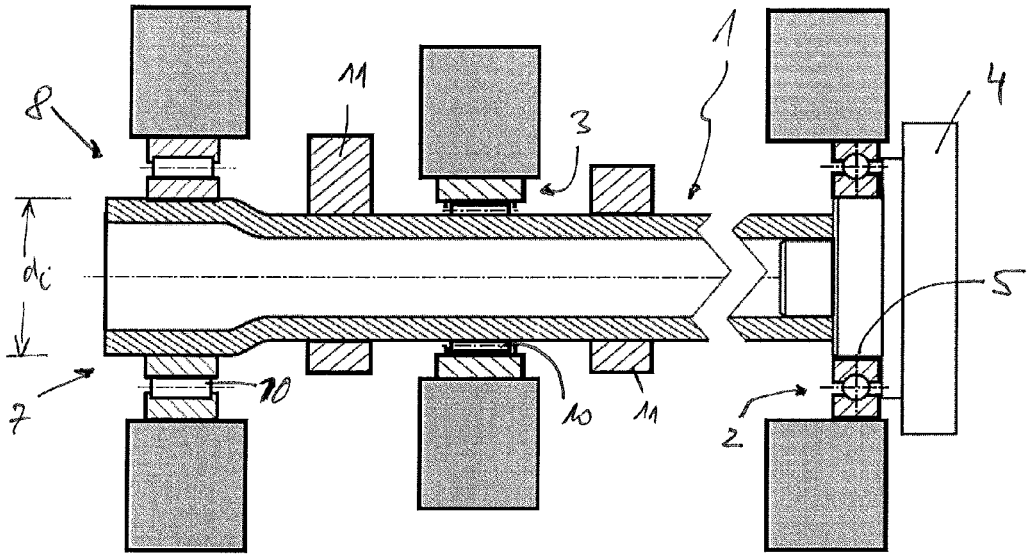

The camshaft 1 according to FIG. 5 likewise comprises a first bearing 2 in the region of the drive wheel 4, wherein in this case the first bearing 2 is again arranged on the radially enlarged bearing shoulder 5 of the drive wheel 4. In the further course, the camshaft 1 comprises at least one second bearing 2, which is likewise designed as a rolling bearing, in the shown case as a needle bearing. Additionally provided is a third bearing 8, which is likewise designed as a needle bearing and has an inner diameter 24 mm$<d_i<$30 mm, wherein the inner diameter $d_i$ of the third bearing 8 is larger than the outer diameter $d_a$ of the camshaft 1 on the second bearing 3. The third bearing 8 in this case is again arranged in an expanded region 7 of the camshaft 1, namely in the present case on the longitudinal end facing away from the drive wheel 4. Providing the third bearing 8 can be required in particular when on the longitudinal end of the camshaft 1 facing away from the drive wheel 4 the forces occurring there require this for example through the arranging of a further drive wheel for example for driving a pump. The first bearing 2 in this case can be designed as a fixed bearing, whereas the second bearing 3 and/or the third bearing 3, 8 are designed as loose bearings. Fixed bearing in this case is to mean that a mounting of the camshaft 1 is made possible not only in radial direction, but additionally also in axial direction.

Figure 6:
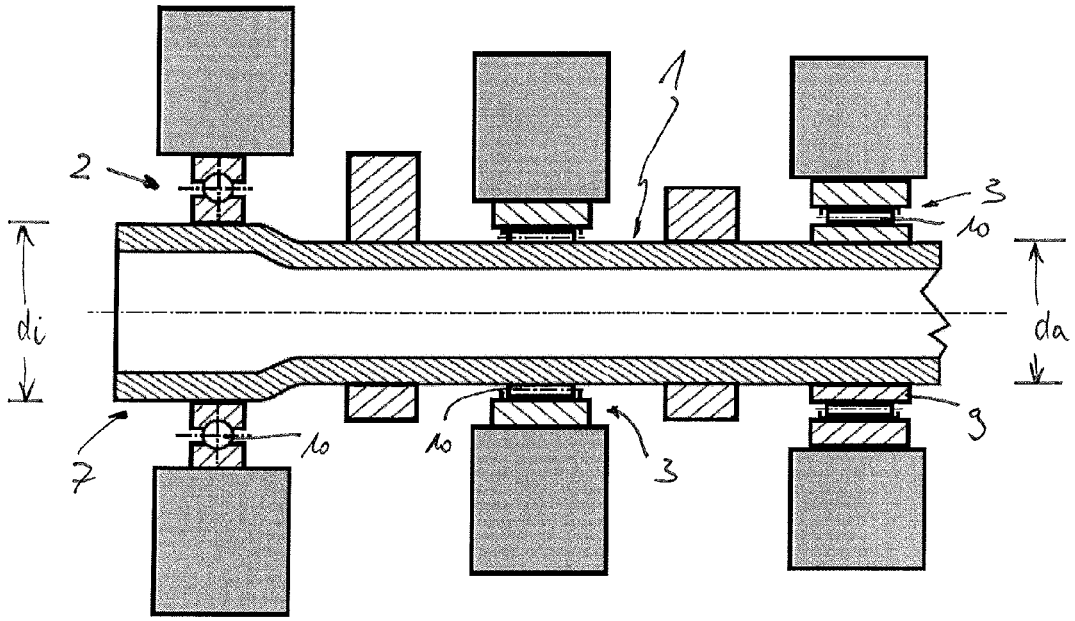

From FIG. 6, finally, a camshaft 1 is shown, which substantially corresponds to the representation in FIG. 4, wherein two different types of second bearings 3 are provided. The middle second bearing 3 in this case has rolling bodies 10, i.e. in the present case needles, which run directly on an outer surface of the camshaft 1, whereas the right second bearing 3 additionally comprises an inner race 9, on which the rolling bodies 10, i.e. the needles can roll. The inner race 9 in this case can be pressed onto an outer surface of the camshaft 1 or joined by means of a thermal joining fit. The middle second bearing 3 in this case is a more compact construction than the right second bearing 3.

Between the individual bearings 2, 3, 8, cams 11 for controlling valves of the internal combustion engine are arranged on the camshaft 1 in the known manner. The first bearing 2 in ball drawn embodiments is represented as ball bearing with balls as rolling bodies and in this form makes possible both a radial as well as axial mounting. Obviously conceivable is also the design as a needle bearing in the manner of a fixed bearing.

The mounting of the camshaft 1 according to the invention in this case takes place with ball bearings 2, 3 and if applicable 8 by placing the camshaft 1 into a split cylinder head, wherein alternatively a mounting of outer races in a corresponding bearing gallery in the cylinder head with sliding-in of the stepped camshaft 1 into the bearing gallery later on is conceivable.

With the camshaft 1 according to the invention it is possible to design said camshaft 1 with a clearly reduced outer diameter $d_a$ of for example merely 22 mm throughout the region in an at least predominant region according to the FIGS. 1 and 2 of for example merely 22 mm, as a result of which the camshaft 1 does not only require less installation space but also is significantly lighter, which is noticeable in particular during the installation in an internal combustion engine of a motor vehicle through fuel saving.

The invention claimed is:

1. A camshaft for an internal combustion engine comprising: a drive wheel arranged on a longitudinal end side and including at least one of a chain wheel and belt pulley, at least one first bearing arranged proximate to the drive wheel on a localized radially enlarged region and at least one second bearing supporting the camshaft at a further region, wherein the at least one first bearing includes a rolling bearing having an inner diameter of 24 mm$<d_i<$30 mm, and wherein the inner diameter $d_i$ is larger than an outer diameter $d_a$ of the camshaft at the further region adjacent the at least one second bearing, and wherein the outer diameter $d_a$ of the camshaft at least in the region of the at least one second bearing is 18 mm$<d_a<$24 mm, wherein the localized radially enlarged region is an expanded region of the camshaft on the longitudinal end side having the drive wheel disposed between an axial end face of the camshaft and the at least one second bearing, and wherein the at least one first bearing is arranged on the expanded region, or wherein the localized radially enlarged region includes a sleeve arranged on the longitudinal end side between an axial end face of the camshaft and the at least one second bearing, wherein the at least one first bearing including the rolling bearing has an inner ring mounted on the sleeve.

2. The camshaft according to claim 1, wherein the localized radially enlarged region is the expanded region, and wherein the camshaft extends continuously between the axial end face and the further region.

3. The camshaft according to claim 2, wherein the expanded region is produced through one of internal high-pressure forming, upsetting, and increasing material thickness.

4. The camshaft according to claim 2, wherein the expanded region of the camshaft is obtained through material compaction of the camshaft.

5. The camshaft according to claim 1, wherein the localized radially enlarged region includes the sleeve, wherein the sleeve overlaps the camshaft and the at least one first bearing is mounted on a region of the sleeve overlapping the camshaft.

6. The camshaft according to claim 5, wherein the sleeve is one of pressed onto the camshaft and thermally joined with the camshaft.

7. The camshaft according to claim 1, wherein the at least one second bearing includes rolling bodies configured to directly run on an outer surface of the camshaft.

8. The camshaft according to claim 1, further comprising a third bearing configured as a rolling bearing, the third bearing having an inner diameter of 24 mm$<d_i<$30 mm, wherein the inner diameter $d_i$, is larger than the outer diameter $d_a$ of the camshaft adjacent the second bearing.

9. The camshaft according to claim 8, wherein the third bearing is arranged on an expanded longitudinal end region of the camshaft.

10. The camshaft according to claim 1, wherein the outer diameter $d_a$ is 22 mm.

11. The camshaft according to claim 1, wherein the at least one second bearing includes an inner race arranged on the camshaft.

12. The camshaft according to claim 11, wherein the at least one second bearing includes rolling bodies configured to roll on the inner race.

13. The camshaft according to claim 1, wherein the camshaft includes multiple second bearings, at least two of which are not identical.

14. The camshaft according to claim 1, further comprising a third bearing including rolling bearings, an inner diameter of which is 24 mm$<d_i<$30 mm.

15. The camshaft according to claim 1, further comprising a third bearing having an inner diameter $d_i$ that is larger than the outer diameter $d_a$ of the camshaft adjacent the at least one second bearing.

16. A camshaft for an internal combustion engine, comprising:

a hollow shaft tube defining a longitudinal axis and extending continuously between two longitudinal ends;

a drive wheel arranged on one longitudinal end of the shaft tube;

at least one first bearing arranged at the one longitudinal end proximate to the drive wheel; and at least one second bearing supporting the shaft tube at a further region;

wherein the shaft tube has a first outer diameter at the one longitudinal end and a second outer diameter at the further region, wherein the first outer diameter is greater than the second outer diameter;

wherein the at least one first bearing is arranged on the first outer diameter of the shaft tube, the at least one first bearing having an inner diameter ranging from 24 mm to 30 mm, and wherein the inner diameter of the at least one first bearing is larger than the second outer diameter of the shaft tube adjacent the at least one second bearing.

17. The camshaft according to claim 16, wherein the first outer diameter is defined by a radial expansion of the shaft tube at the one longitudinal end, and wherein the at least one first bearing is arranged on the radial expansion.

18. The camshaft according to claim 17, wherein the radial expansion defining the first outer diameter is formed via at least one of internal high-pressure working and upsetting.

19. The camshaft according to claim 16, wherein the first outer diameter is defined by a sleeve arranged on the shaft tube, and wherein the at least one first bearing includes a rolling bearing having an inner ring coupled to the sleeve.

20. The camshaft according to claim 16, wherein the second outer diameter of the shaft tube adjacent the at least one second bearing ranges from 18 mm to 24 mm.

* * * * *